US005607196A

United States Patent [19]

Weger

[11] Patent Number: 5,607,196

[45] Date of Patent: Mar. 4, 1997

[54] HAND-HELD GRIPPING DEVICE

[76] Inventor: Kenneth J. Weger, 28595 W. Hillcrest Ave., Cary, Ill. 60013

[21] Appl. No.: 639,700

[22] Filed: Apr. 29, 1996

[51] Int. Cl.[6] ..... B25B 9/02

[52] U.S. Cl. ..... 294/99.2; 294/1.1

[58] Field of Search ..... 294/1.1, 1.3, 16, 294/25, 99.2, 19.2; 206/0.8, 0.82; 150/150; 623/65

[56] References Cited

U.S. PATENT DOCUMENTS

| | | | |
|---|---|---|---|
| 580,148 | 4/1897 | Staples . | |
| 1,156,459 | 10/1915 | Brown | 294/99.2 |
| 2,667,906 | 2/1954 | Stiller | 150/150 |
| 2,985,044 | 5/1961 | Gill . | |
| 3,975,043 | 8/1976 | Miles . | |
| 4,148,510 | 4/1979 | Brack et al. | 294/1.3 |
| 4,188,055 | 2/1980 | Green . | |
| 4,523,781 | 6/1985 | Brody | 623/65 |
| 4,768,818 | 9/1988 | Kolic . | |
| 4,846,025 | 7/1989 | Keller et al. . | |
| 4,854,624 | 8/1989 | Baymiller . | |
| 5,222,777 | 6/1993 | Clonch . | |

*Primary Examiner*—Dean Kramer
*Attorney, Agent, or Firm*—Leydig, Voit & Mayer, Ltd.

[57] ABSTRACT

A hand-held gripping device allows a user to pick up small objects with relative ease. The gripping device has a resilient hollow body with two generally symmetrical side surfaces and a normally open mouth with two pointed corners. Each side surface has a lip portion extending to a curved edge at the mouth. The side surfaces are responsive to compressional forces exerted by a user's hand, whereby they curl towards each other and close the mouth. The closing of the mouth allows a small object to be captured.

20 Claims, 2 Drawing Sheets

HAND-HELD GRIPPING DEVICE

FIELD OF THE INVENTION

This invention relates generally to gripping devices for handling objects, and more particularly to hand-held gripping devices for picking up small objects.

BACKGROUND OF THE INVENTION

People with unsteady hands or limited control of their fingers often encounter significant difficulties in gripping small objects with their fingers, such as picking up a pill or a paper clip with their finger tips. Similar difficulties are experienced by people who have restricted mobility of their fingers caused by symptomatic joints, such as inflammation, arthritis, or the like. For those people with limited hand/finger dexterity, a hand-held gripping device that allows the person to pick up small objects with relative ease is clearly desirable. Conventional hand-held gripping devices (such as tweezers, needle nose pliers or the like) for handling small objects are not suitable for such use due to the hand dexterity required to operate them.

Some hand-held gripping devices proposed in the past use a pair of relatively wide side members which are hinged or otherwise connected so that the two side members can be pivoted towards each other to grip an object or to scoop the object up with the edges of the side members. Such devices can be seen, for example, in U.S. Pat. No. 3,975,043 to Miles, and U.S. Pat. No. 4,188,055 to Green. These devices are designed for handling relatively large objects, such as animal excrement or fish, and are generally unsuitable for the purpose of handling small objects. Their relative large sizes also make them difficult to operate by a person with restricted finger control or mobility. Another problem with those gripping devices with two pivotable side members is that such a device does not reliably retain a small object scooped up by the edges of the side members. Typically, the two side members of such a gripping device form two side openings when their respective edges engage each other. Thus, a small object scooped up by the edges may escape from the gripping device through the side openings during subsequent handling by the user. This problem is especially significant for people with unsteady hands.

Thus, there remains a need for a gripping device which is suitable for use by people with limited hand or finger dexterity and which will allow the person to pick up small objects. The device is desirably hand-held and operable with limited finger movements by the person using the device.

SUMMARY OF THE INVENTION

Accordingly, it is a primary object of the present invention to provide a hand-held gripping device that can be used by a person with limited finger mobility or control to reliably pick up small objects with relative ease.

To that end, it is an object of the invention to provide a hand-held gripping device that is capable of picking up a small object upon relatively minor finger movements of the hand operating it, and is capable of reliably retaining the captured small object during subsequent handling.

It is a related object of the invention to provide a hand-held gripping device that can be operated without requiring precise control of the hand operating it.

It is another related object of the invention to provide a hand-held gripping device that can be operated readily with either hand of a user.

It is a further object of the invention to provide a hand-held gripping device that facilitates transfer of the captured small object directly into the operator's hand.

It is yet another related object of the present invention to provide a hand-held gripping device that is simple in structure and inexpensive to manufacture.

In accordance with these and other objects of the present invention, there is provided a gripping device that has a unitary hollow body made of resilient material and a mouth that closes when the body is compressed by, for example, the fingers of a user's hand. The unitary body has generally a prolate spheroid shape with a longitudinal lune removed therefrom to form the mouth. The body has first and second convex side surfaces for receiving external compressional forces, and first and second lip portions on, respectively, the first and second side surfaces. The first and second lip portions form the mouth and are joined at two pointed corners. Each of the lip portions includes a generally arcuate edge. The mouth assumes an open position when no compressional forces are applied to the side surfaces. The first and second side surfaces are responsive to external compressional forces to curl towards each other and cause alteration of the mouth from the open position to a closed position. The closing of the mouth allows a small object to be captured by the gripping device.

It is a feature of the present invention to provide a gripping device with a resilient hollow body and a mouth that can be closed. When the mouth is closed, the hollow body of the gripping device encloses a substantially closed cavity. Thus, a small object that has been scooped up by the edges of the mouth is retained within the gripping device when the mouth remains closed, and will not accidentally fall out of the gripping device. It is another feature of the present invention that the side surfaces of the resilient hollow body curl towards each other under external compressional forces to close the mouth. Due to such curling motion of the side surfaces, only relatively minor finger movements of the user's hand operating the gripping device are required to close the mouth.

It will be appreciated that the mouth of the device need not be fully closed in order for the device to be operable. In some instances, the object may be trapped by the lip portions of the mouth to facilitate transfer to the hand.

Other objects and advantages will become apparent from the following detailed description when taken in conjunction with the drawings, in which:

DETAILED DESCRIPTION OF THE PREFERRED EMBODIMENT

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

Figure 1:
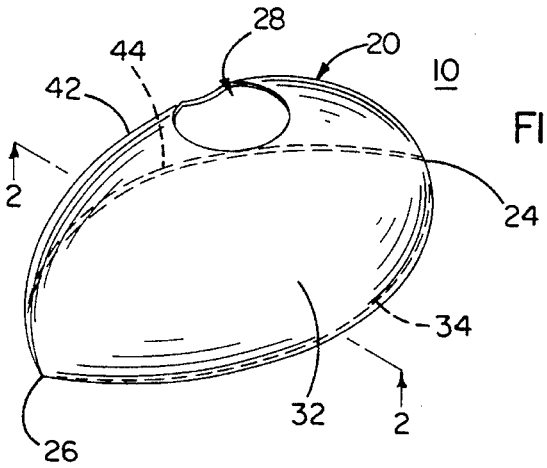
FIG. 1 is a side perspective view of an embodiment of a gripping device constructed according to the present invention.
Figure 2:
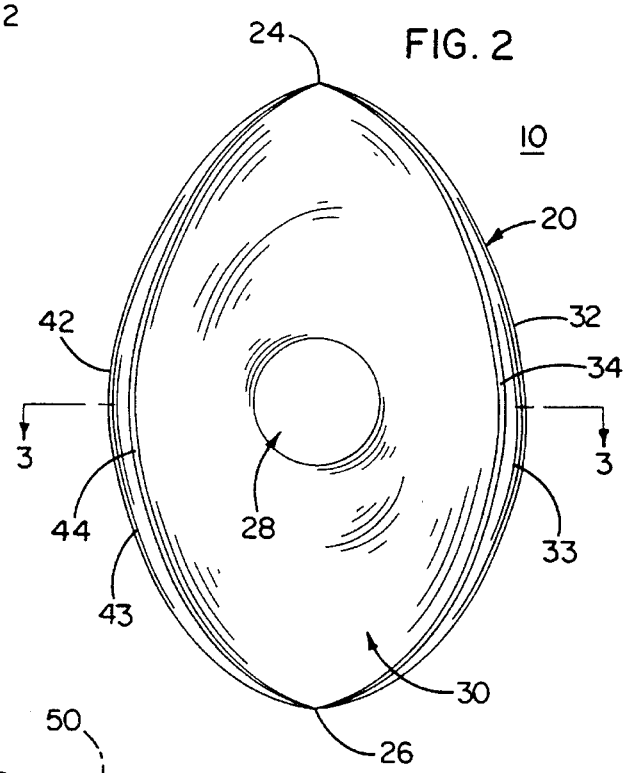
FIG. 2 is a bottom elevation of the gripping device of FIG. 1.

Turning now to the drawings, FIG. 1 shows, in a perspective view, an embodiment of the gripping device of the present invention. A bottom view of the same embodiment is shown in FIG. 2. As illustrated in FIGS. 1 and 2, the gripping device 10 has a unitary hollow body 20 with an open end. The hollow body 20 has a general shape of a prolate spheroid (i.e., a football shape), with a longitudinal lune removed therefrom to form a mouth 30 with two generally arcuate edged 34, 44. A body having this shape can be formed, for example, by deforming a segment of a sphere, such as a hemisphere, to form two pointed corners 24, 26 that are opposedly disposed at the open end.

The hollow body 20 comprises a shell formed of resilient material, which preferably is a type of resilient plastic or rubber. In the illustrated embodiment, the hollow body 20 is generally smoothly curved and terminates at the two pointed corners 24, 26. The hollow body 20 forms two convex side surfaces 32, 42 which are generally symmetrical and include, respectively, lip portions 33, 43, which have, respectively, curved edges 34, 44. The curved edges 44 extend to, and are joined at, the two pointed corners 24, 26. In this way, the two lip portions 33, 43 form a mouth 30, and the pointed corners 24, 26 form the ends of the mouth. The hollow body 20 of the gripping device 10 is preferably sized such that it can fit easily into the hand of a user.

As will be described in greater detail below, when the side'surfaces 32, 42 of the body 20 are compressed by the fingers of a user's hand, the entire resilient body is deformed by the compressional forces, and the two side surfaces 32, 42 curl towards each other, thereby tending to cause the mouth 30 to close. Preferably, the mouth can be fully closed by this operation. Accordingly, the device can be used to pick up small objects, such as pills, coins, paper clips, etc., that can be captured in the body of the device or that can be held by the lip portions of a partially closed mouth.

Figure 3:
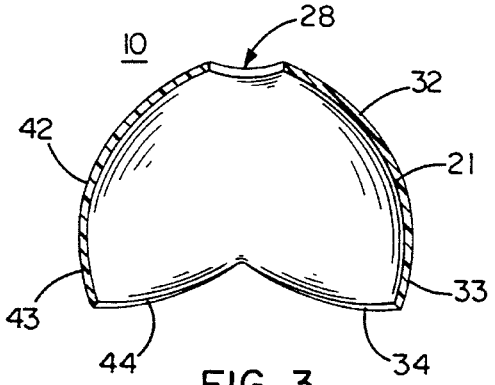
FIG. 3 is a cross sectional view of the gripping device along the line 3—3 in FIG. 2.

FIG. 3 shows the cross sectional view of the gripping device 10 along the line 3—3 in FIG. 2, i.e., through the broadest section of the hollow body 20. As illustrated in FIG. 3, the hollow body 20 of the present embodiment is formed of a thin wall 21 of resilient material. Preferably the thin wall 21 is sufficiently thin and resilient that it remains flexible, and yet is rigid enough that the wall retains its generally arcuate shape. The wall 21 is preferably made of polyethylene terephthalate having a thickness in a range of about to 1.2 millimeters. The wall 21 is also preferably substantially transparent (although it may be colored) so that a user operating the gripping device to capture a small object can see the location of the small object during the operation.

Figure 4:
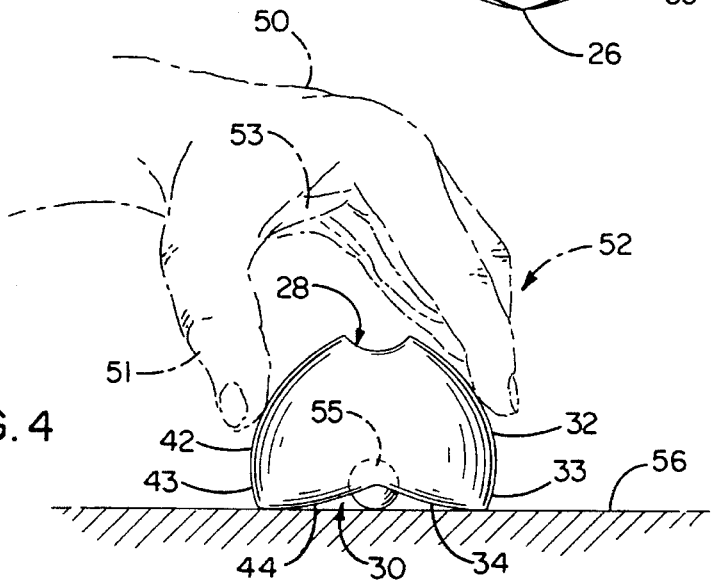
FIG. 4 is a perspective view illustrating the gripping device held in a user's hand exemplifying the practice of the present invention.

The operation of the gripping device will now be described in conjunction with FIGS. 4–7. FIG. 4 shows the gripping device 10 held in a user's hand 50. Typically, the thumb 51 of the user's hand contacts one side surface 42, and the other fingers 52 contact the other side surface 32. Also shown in FIG. 4 is a small object 55 to be picked up by the gripping device, lying on a support surface 56. To pick up the small object 55, the user positions the gripping device 10 over the small object 55, and exerts compressional forces on the side surfaces 32, 42 by means of the fingers 51, 52 holding the gripping device. In response to the compressional forces, the side surfaces 32, 42 curl towards each other generally about an axis defined by the two pointed corners 24, 26. Such curling causes the curved edges 44 to approach each other and to ultimately engage if sufficient compressional forces are applied. Because the body 20 of the gripping device 10 is formed of resilient material, it returns to its initial (relaxed) shape once the user relieves the compressional forces on the side surfaces 32, 42.

Figure 5:
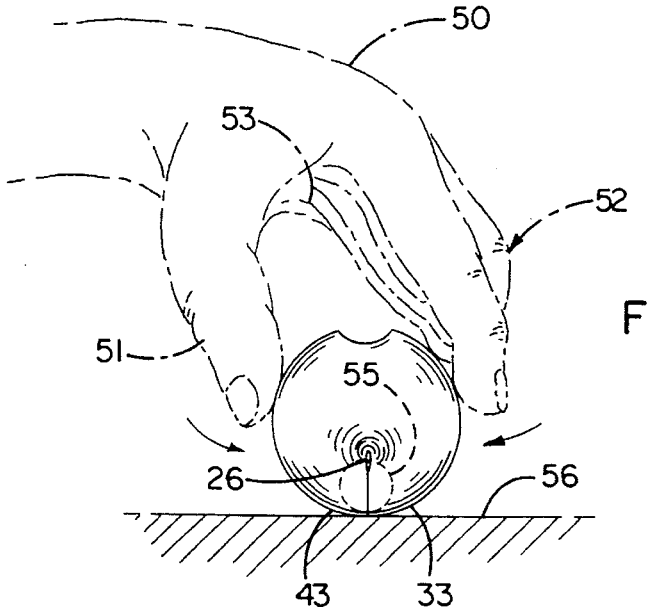
FIG. 5 is a perspective view illustrating the gripping device held in a user's hand with the mouth of the gripping device closed.
Figure 7:
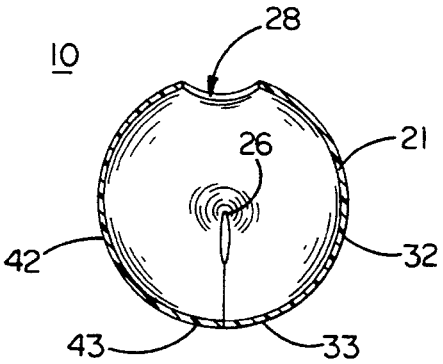
FIG. 7 is a cross sectional view of the gripping device with the mouth closed.

There are two ways the user can capture the small object 55 with the gripping device. The first is to catch and grip the small object 55 between the two curved edges 34, 44. The second, which is the more convenient and therefore preferred, is to scoop the small object 55 into the body of the gripping device. To practice the second method, the user holds the mouth 30 over the small object 55 with the curved edges 34, 44 in contact with the support surface 56, and then compresses the side surfaces 32, 42 of the body. As the mouth 30 closes, the curved edges 34, 44 extend under the small object 55 and scoop it into the hollow body of the gripping device. FIG. 5 shows the gripping device 10 held in the user's hand 50 with the mouth closed and the small object 55 scooped into the body of the gripping device. Once the small object 55 is captured, the user can move the gripping device 10 to another location and drop the small object onto a desired place, such as the user's other hand, by relieving the forces on the side surfaces 32, 42 and opening the mouth 30.

Figure 6:
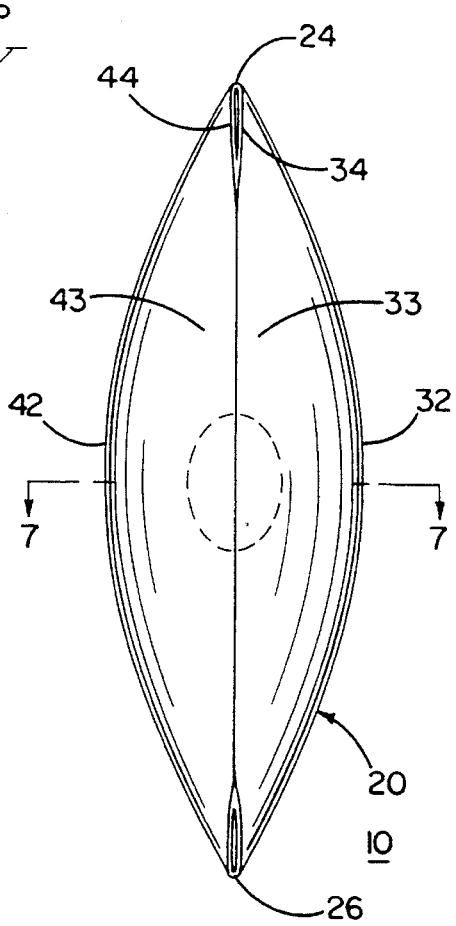
FIG. 6 is a bottom elevation of the gripping device with the mouth closed.

FIG. 6 shows the bottom view of the gripping device 10 with the mouth closed. It will be appreciated that when the mouth is closed, the hollow body 20 encloses a substantially closed cavity, and the gaps between the two edges 34, 44 near the pointed corners 24, 26 are sufficiently small to prevent the small object 55 (FIG. 5) from accidentally passing therethrough. Thus, the gripping device is capable of reliably retaining a small object after it is captured, even if the user's hand is somewhat unsteady. It will be further appreciated that relatively minor finger movements are sufficient to operate the gripping device 10. This is because the closing of the mouth results from the curling of the side surfaces 32, 42. As can be best seen in a comparison between FIG. 4 and FIG. 5, the amount of finger movements required to close the mouth is significantly less than would be required to pick up the small object directly with the finger tips of the user's hand 50.

The configuration of the lip portions 33, 43 of the mouth is important for the above-described scooping operation. In the preferred embodiment, the curvature of the lip portions 33, 43 is such that the lip portions are substantially tangential to each other when the mouth is in the closed position, as illustrated in the cross sectional view of FIG. 7. As can be best seen in FIG. 5, with this configuration, the lip portions are nearly tangential to the support surface 56 when the mouth is about to close, thereby allowing the curved edges 34, 44 to extend under the small object 55 and lift it up with relative ease.

Referring back to FIGS. 1 and 2, as an ancillary feature of the present invention, the illustrated embodiment of the gripping device 10 is provided with an aperture 28 on the apex of the body 20 opposite the mouth 30. After a small object 55 has been captured within the gripping device, as illustrated in FIG. 5, the user can easily transfer the small object 55 into his/her hand by rotating the hand holding the device so that the palm 53 faces upward, thus allowing the small object 55 to drop through the aperture 28 into the palm.

Figure 8:
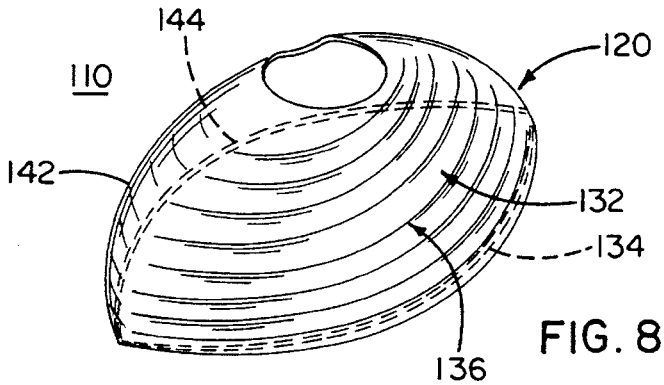
FIG. 8 is a perspective view showing an alternative embodiment of the gripping device having surface patterns on its sides.

As another ancillary feature, the wall of the hollow body of the gripping device may be provided with raised or recessed surface patterns. Such patterns can be disposed on the side surfaces of the body to make the surfaces less susceptible to slipping in the fingers of a user's hand. Such patterns can also be used to control the deformation of the body under compressional forces. An example of a gripping device with surface patterns is shown in FIG. 8. In the illustrated embodiment, the gripping device 110 has embossed flutes 136 on the side surfaces 132, 142 running generally parallel to the curved edges 134, 144 of the mouth.

It will be appreciated now that what has been provided is a gripping device which allows a user with limited hand control or finger mobility to pick up small objects with relative ease. The gripping device has a very simple structure, comprising a hollow body with a normally open mouth. The hollow body is deformed under compressional forces exerted by the fingers of a user's hand to cause the closing of the mouth, which is used to capture small objects. Because the hollow body encloses a substantially closed cavity when the mouth is closed, a small object scooped up by the edges of the mouth can be reliably retained in the gripping device for subsequent handling. Because the closing of the mouth is caused by the curling of the side surfaces towards each other, relatively minor finger movements are required to operate the gripping device.

What is claimed is:

1. A gripping device for capturing small objects, comprising:

a unitary hollow body formed of resilient material having a generally prolate spheroid shape with a longitudinal lune removed therefrom, the body including:

first and second convex side surfaces for receiving external compressional forces, and first and second lip portions on, respectively, the first and second side surfaces forming a mouth joined at two pointed ends, each of the lip portions including a generally arcuate edge, the mouth assuming an open position when there are no compressional forces on the side surfaces, the first and second side surfaces being responsive to external compressional forces to curl towards each other and cause movement of the mouth from the open position to a closed position, wherein the closing of the mouth allows a small object to be captured.

2. A gripping device as in claim 1, wherein the body is made of resilient plastic material.

3. A gripping device as in claim 2, wherein the body is substantially transparent.

4. A gripping device as in claim 1, wherein the body includes an aperture through which an object captured by the gripping device may pass to allow the transfer of the object into a hand holding the gripping device.

5. A gripping device as in claim 4, wherein the aperture is disposed at an apex of the body opposite the mouth.

6. A gripping device as in claim 1, wherein the side surfaces of the body includes embossed patterns.

7. A gripping device as in claim 6, wherein the side surfaces of the body includes flutes running generally parallel to the edges of the lip portions.

8. A gripping device as in claim 1, wherein the hollow body is formed from a laterally deformed segment of a sphere.

9. A gripping device as in claim 1, wherein the two lip portions are substantially tangential to each other when the mouth is in the closed position.

10. A gripping device operable by a user's hand, comprising a thin-walled hollow body of resilient material having an open end, the hollow body being generally smoothly curved except at two pointed corners oppositely disposed at the open end and having two generally symmetrical side surfaces each extending to a curved edge at the open end, the curved edges being joined at the two pointed corners, the side surfaces being responsive to compressional forces exerted by fingers of the user's hand holding the gripping device to curl towards each other to close the open end, thereby allowing the capture of a small object.

11. A gripping device as in claim 10, wherein the hollow body is formed of resilient plastic material.

12. A gripping device as in claim 10, wherein the body includes an aperture through which a small object captured by the gripping device may pass into the hand holding the gripping device.

13. A gripping device as in claim 12, wherein the aperture is disposed at an apex of the hollow body opposite the open end.

14. A gripping device as in claim 10, wherein the side surfaces of the body includes embossed patterns for facilitating gripping of the body by a user's hand.

15. A gripping device as in claim 10, wherein the side surfaces of the body includes flutes running generally parallel to the edges of the lip portion.

16. A gripping device for operation by a user's hand for capturing small objects, comprising:

a hollow shell of resilient material formed from a segment of a sphere deformed to have two pointed corners opposite each other at an open end of the shell and two generally symmetrical side surfaces each having an edge portion terminated at a curved edge at the open end, the two curved edges being joined at the two pointed corners, the shell being sized for fitting into a user's hand, the side surfaces being responsive to compressional forces exerted by fingers of a user's hand to curl towards each other about an axis defined by the two pointed corners to cause the two curved edges to approach each other and close the open end.

17. A gripping device as in claim 16, wherein the shell is made of resilient plastic material.

18. A gripping device as in claim 16, wherein the shell includes an aperture through which an object captured by the gripping device may pass into a hand holding the gripping device.

19. A gripping device as in claim 16, wherein the side surfaces of the shell includes embossed patterns.

20. A gripping device as in claim 16, wherein the edge portions of the two side surfaces are substantially tangential to each other when the respective edges are engaged.

* * * * *